US006119798A

United States Patent [19]

Fischer et al.

[11] Patent Number: 6,119,798

[45] Date of Patent: Sep. 19, 2000

[54] ROCK DRILL BIT AND CUTTING INSERTS

[75] Inventors: Udo Fischer, Vällingby; Torbjörn Hartzell, Stockholm; Kauko Kärki, Skogås, all of Sweden

[73] Assignee: Sandvik AB, Sandviken, Sweden

[21] Appl. No.: 08/809,575

[22] PCT Filed: Oct. 4, 1995

[86] PCT No.: PCT/SE95/01147

§ 371 Date: Mar. 26, 1997

§ 102(e) Date: Mar. 26, 1997

[87] PCT Pub. No.: WO96/12086

PCT Pub. Date: Apr. 25, 1996

[30] Foreign Application Priority Data

Oct. 12, 1994 [SE] Sweden ..... 9403452
Mar. 7, 1995 [SE] Sweden ..... 9500808

[51] Int. Cl.[7] ..... E21B 10/36

[52] U.S. Cl. ..... 175/420.2; 175/430; 175/432; 175/434

[58] Field of Search ..... 175/414, 420.1, 175/420.2, 426, 428, 430–432, 434

[56] References Cited

U.S. PATENT DOCUMENTS

| | | | |
|---|---|---|---|
| 4,572,307 | 2/1986 | Tunell | 175/426 |
| 4,598,779 | 7/1986 | Liljekvist et al. | 175/426 |
| 4,607,712 | 8/1986 | Larsson | 175/426 |
| 4,724,913 | 2/1988 | Morris | 175/430 |
| 5,248,006 | 9/1993 | Scott et al. | 175/432 X |

*Primary Examiner*—Roger J. Schoeppel
*Attorney, Agent, or Firm*—Burns, Doane, Swecker & Mathis, L.L.P.

[57] ABSTRACT

The present invention relates to a cutting insert for a rock drill bit. The rock drill bit includes a tool body (10) having a front surface (13), and a number of cutting inserts (14), each having a generally cylindrical shank portion. The cutting insert (14) is provided with increased volume portions in its parts being most subjected to wear. The invention also relates to the rock drill bit.

7 Claims, 6 Drawing Sheets

ROCK DRILL BIT AND CUTTING INSERTS

BACKGROUND OF THE INVENTION

The present invention relates to inserts of cemented carbide bodies and rock drill bits preferably for percussive rock drilling.

In U.S. Pat. No. 4,598,779 is shown a rock drill bit that is provided with a plurality of chisel-shaped cutting inserts. Each insert discloses a guiding surface that is relatively sharply connected to cutting edges. A relatively sharp connection is disadvantageous when using cemented carbide. That is, flaking may occur during severe rock drilling due to tension in the connections, such that straight holes may not be achieved in the long run. Also the shape of the known insert is not optimized for maximum wear volume. U.S. Pat. No. 4,607,712 discloses a rock drill bit which has a plurality of cutting inserts. The working part of each insert has a semispherical basic shape, to which has been added extra volume of cemented carbide. However, the prior art insert does not sufficiently support against the wall of the bore such that straight holes may not be achieved. Furthermore, connections between the components of the working part are relatively sharp thereby producing the above-mentioned tensions detrimental for hard cemented carbide. In addition, the spherical basic shape holds a relatively small volume of cemented carbide.

OBJECTS AND SUMMARY OF THE INVENTION

It is an object of the present invention to avoid or alleviate the problems of the prior art. One object of the invention is to increase the wear resistance of cemented carbide bodies preferably for use in tools for rock drilling and mineral drilling. The wear resistance of the cemented carbide body can be increased by increasing the body volume in the area exposed to wear. In order to reach a distinct increase of the wear resistance, the volume of the area exposed to wear has to be increased essentially. A distinct increase of the wear resistance can be obtained when increasing the volume of the outer zone which is exposed to wear when the tool is in operation by at least 50%, probably 100% or more. Inserts in percussive drill bits wear most in the area which comes in contact with a hole wall and in the top of the insert where the rock has to be broken. In order to increase the wear resistance of an insert, the volume of the outer zone has to be increased in the area coming in contact with the wall and in the top. Prior art tools normally have inserts with an axial-symmetric top design (left part of FIG. 12). An increase of the outer zone which is exposed to wear often leads to a non-axial symmetric top. Due to the nature of the wear, which depends on the rock properties and the drilling conditions, the wear appears pronounced in the area coming in contact with the wall or in the top area where the rock is broken. It is important to respect this fact and increase the volume of the outer zone most where the inserts wear most.

Both longer life and higher penetration rate can be achieved because the optimal geometrical structure will not be destroyed as fast. An important advantage of the invention is a higher precision when using the material in drill bits. The enlargened volume of wear resistant material and thus the high wear resistance of the outer zone in the area exposed to wear, provides for straighter holes and much better diameter tolerances of the drilled hole. Also the intervals of regrinding can be prolonged; this leading to less efforts and dangers to the driller.

A still further object of the present invention according to a dependent claim where a polycrystalline diamond coating is provided on at least the working portion of the insert is to enhance the life of the insert although the PCD-coating may have cracked or flaked off.

The objects of the present invention are realized by an insert and a rock drill bit that has been given the characteristics of the appending claims.

BRIEF DESCRIPTION OF THE FIGURES

FIG. 1 shows an insert according to the present invention, in a side view.

FIG. 2 shows the insert in another side view.

FIG. 3 shows the insert in a top view.

FIG. 4 shows the insert in a view according to arrow B in FIG. 2.

FIG. 5 shows an enlarged cross-section of the insert as seen at line 5.

FIG. 6 shows an insert according to the present invention, in a side view.

FIG. 7 shows the insert in another side view.

FIG. 8 shows the insert in a top view.

FIG. 9 shows the insert in a view according to arrow B in FIG. 7.

FIG. 10 shows an enlarged cross-section of the insert as seen at line 5'.

DETAILED DESCRIPTION OF THE PREFERRED EMBODIMENTS OF THE INVENTION

Figure 1:
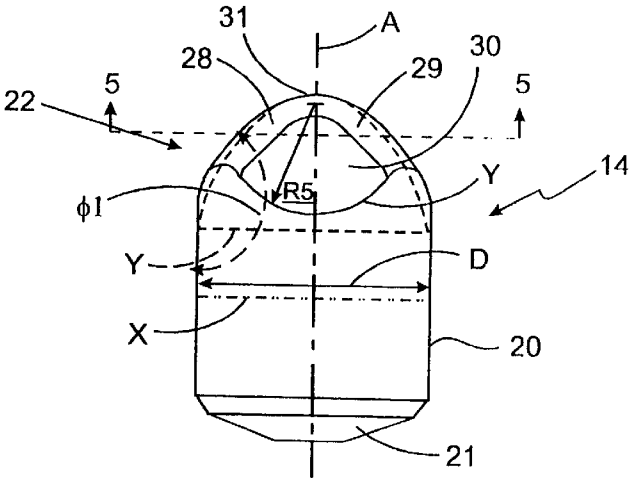
Figure 3:
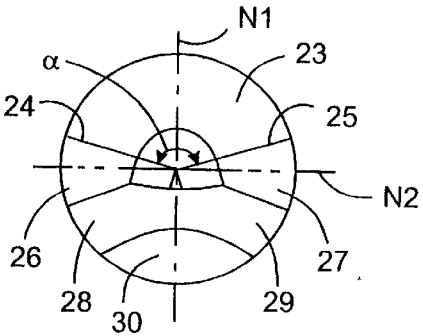

FIG. 1 shows an enlarged side view of a preferred embodiment of an insert according to the present invention. The insert has a generally cylindrical shank portion 20 having a diameter D within the interval 4 to 20 mm, preferably 7 to 18 mm. The mounting end 21 of the insert 14 has preferably a frusto-conical shape adapted to enter into a hole in the drill head front surface, see FIG. 11. Preferably, the hole emerges both in the front surface as well as the jacket surface. In the figures the longitudinal center axis A of the insert and two right-angled normals N1 and N2 are shown. A line Y is defined as the base of the working part 22. The line may be distinct or smooth.

Figure 2:
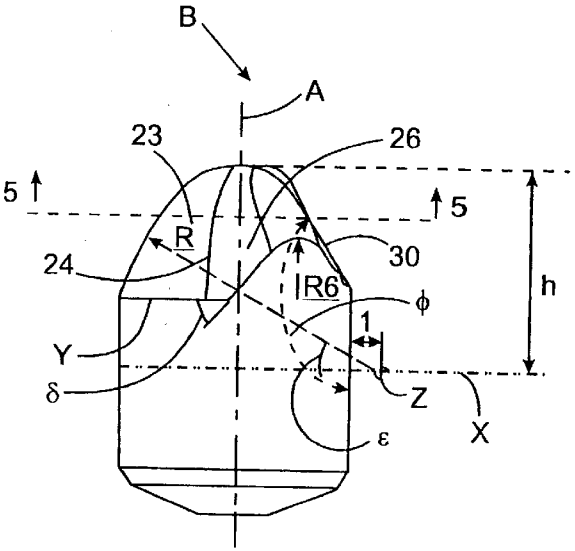
FIGS. 1–5 show an insert suitable to drill under conditions where the wear of the insert is concentrated in the area close to the wall.
Figure 5:
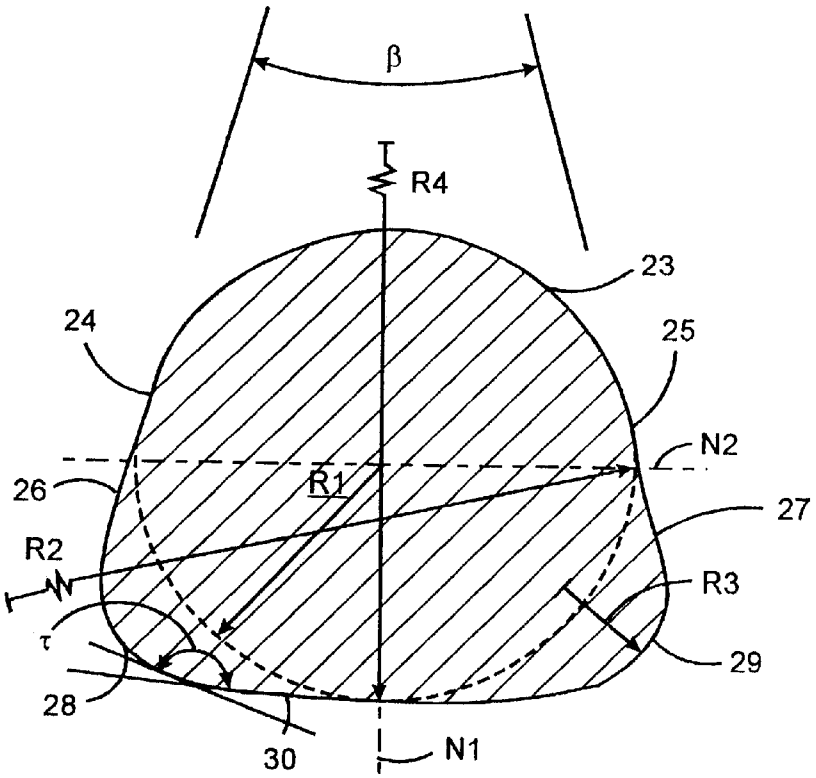

The working part 22 of the insert 14 is divided into seven smoothly connecting substantially circumferentially and axially convex portions. By the expression "smooth" or "smoothly" is hereinafter meant that two tangents, perpendicular to the center axis A in side view, each disposed on separate sides in the immediate vicinity of the connection, form an angle $\tau$ which is in the interval of 135° to 180°, preferably 160° to 175° (FIG. 5). A first portion 23 describes a generally ballistic shape and extends generally symmetrically on both sides of the normal N1. The first portion ends circumferentially at symmetrically disposed radius zone lines 24 and 25, respectively. The radius of the first portion in a certain axial cross-section 5 is designated R1. The mathematical construction of the ballistic shape is as follows:

The reference plane X of the first portion 23 lies beneath the base line Y in FIG. 2. The convex curvature of the first portion 23 is struck from the radii R with a center Z in the vicinity of the envelope surface of the shank portion 20. The center Z is preferably placed outside the envelope surface a distance l and below the axially forwardmost point a distance h. The distance h is 4 to 8 times the distance l but smaller than the radius R. The reference plane X and the radii R enclose an angle E between 10° and 75°.

Each radius zone line 24 and 25, respectively, and the normal N1, seen in a top view, enclose an angle α within the interval of 45° to 85°. It is understood that the ballistic convex curvature radially outermost is connected to the envelope surface of the shank portion 20.

Figure 4:
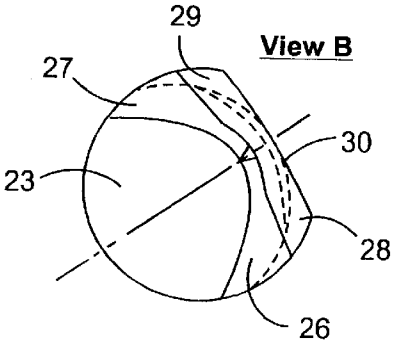

The radius zone line 24 or 25 represents a smooth transition between the first portion 23 and a second portion 26 or 27. The second portion 26 or 27 is except for the immediate junction with the first portion, disposed generally outside the ballistic basic shape (drawn with broken lines in FIGS. 1, 2 and 4). The radius R2 of the second portion in the cross-section 5 is larger than the radius R1 of the first portion. The second portion substantially tapers in the forward direction of the centre axis A. The second portions 26, 27 taper towards the first portion 23 and form an acute angle β.

The second portion 26 or 27 further connects to a third portion 28 or 29. The third portions merge radially off the axis A at the front portion of the insert. The third portions are crestlike strong edges that machine the rock mainly in the circumferential direction. A tangent of the third portion at the intersection of cross-section 5 is at larger internal angle φ1 with respect to the envelope surface of the shank portion than are corresponding tangents of the first and second portions. The magnitude of angle φ1 causes an increase in material to wear in comparison with an entire ballistic configuration and thus increases the wear resistance of the insert. The third portion is defined by a radius R3 which is smaller than both the radius R1 of the first portion and the radius R2 of the second portion in the cross-section 5 (see FIG. 5). The width of the third portion is substantially constant.

The third portion smoothly connects to a fourth portion 30 which is adapted to mainly coincide with and lie mainly flush with the wall of the drilled hole. The fourth portion defines a guiding surface provided to slide on the wall of the bore. The fourth portion has a radius R4 in the cross-section 5, which is much larger than each of the above-mentioned radii R1 and R3. A central tangent of the portion 30 in the cross-section 5—5 forms an internal angle φ relative to the envelope surface of the shank 20. The angle φ is smaller than corresponding angles of each of the other portions 23–27.

A first part of the base line Y connected to the first portion 23, extends substantially perpendicular to the center axis A. A second part of the base line Y connected to the second portion 24 or 25, rises at least partially, forwardly at an acute angle δ relative to the first part. A third part of the base line Y connected to the third portion 28 or 29, discloses the axially forwardmost point of the entire base line and is generally defined by a radius R6. The third part is convex. A fourth part of the base line Y connected to the fourth portion 30, is generally defined by a radius R5 larger than the radius R6. The fourth part is concave and its rearwardmost point lies axially forwards of the first part.

The fifth portion 31 is a rounded apex wherein the portions 23,24,25,26 and 27 merge. The fourth portion 30 ends axially rearwardly of the apex 31. The axially forwardmost part of the third portion 28 or 29 is mainly not a part of the apex although it is connected thereto.

It should be noted that at the base line Y, above-mentioned radii R1, R2, R3 and R4 in a top view projection, are equal, i.e., equal to D/2.

Figure 6:
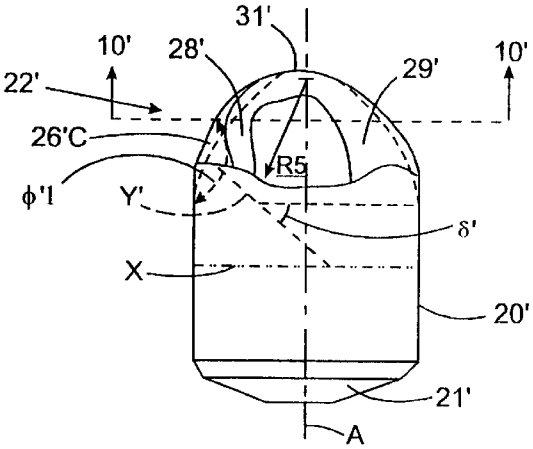
Figure 8:
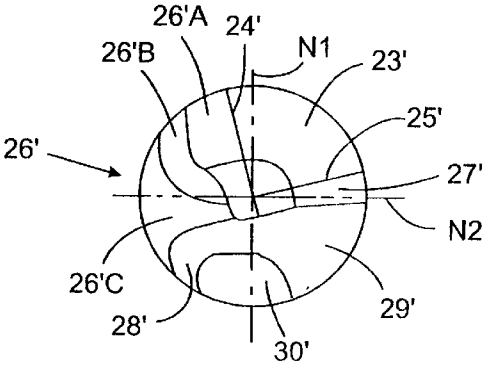

Under certain mining conditions drill inserts may be more worn on one side than on the other and therefore it was developed an insert for use under such conditions, i.e., an insert with a bulk of material disposed asymmetrically with respect to the normal N1. That is, the bulk is disposed on the windward side and an increased clearance surface on the leeward side of the normal N1. FIG. 6 shows an enlarged side view of a preferred embodiment of an insert according to the present invention. The insert has a generally cylindrical shank portion 20' having a diameter D within the interval 4 to 20 mm, preferably 7 to 18 mm. The mounting end 21' of the insert 14' has preferably a frusto-conical shape adapted to enter into a hole (not shown) in the drill head front surface. Preferably, the hole emerges both in the front surface as well as the jacket surface. In the figures the longitudinal center axis A of the insert and two right-angled normals N1 and N2 are shown. A line Y' is defined as the base of the working part 22'.

The working part 22' of the insert 14' is divided into a number of smoothly connecting substantially circumferentially and axially convex portions. A first portion 23' describes a generally ballistic shape and extends asymmetrically on both sides of the normal N1. The first portion ends circumferentially at asymmetrically disposed radius zone lines 24' and 25', respectively. The radius of the first portion in a certain axial cross-section 10' is designated R1. The mathematical construction of the ballistic shape has been discussed above.

Figure 10:
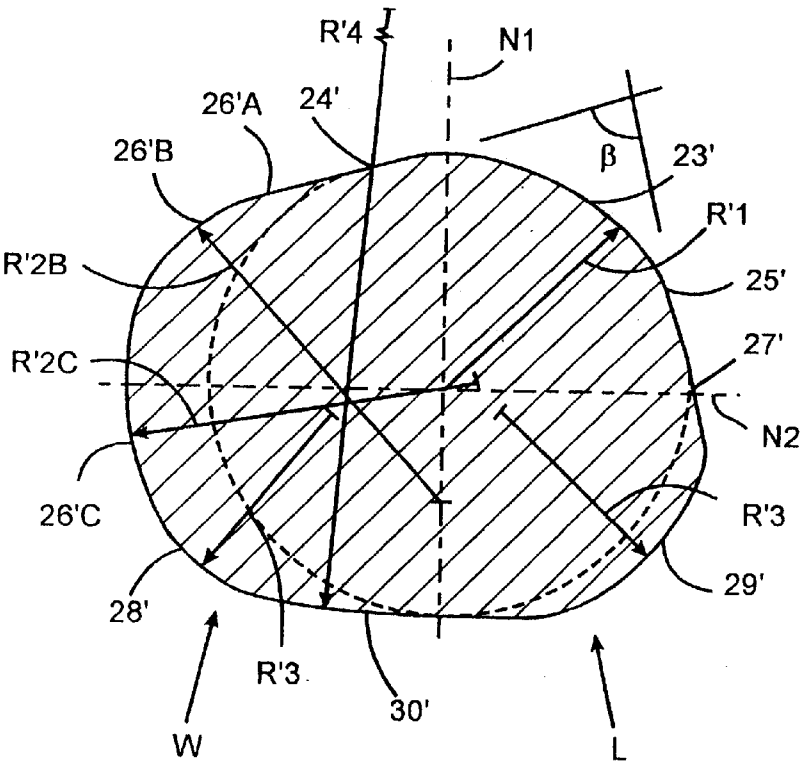
FIGS. 6–10 show an insert suitable to drill under conditions where the wear of the insert is distributed in the area close to the wall and in the top area.
Figure 7:
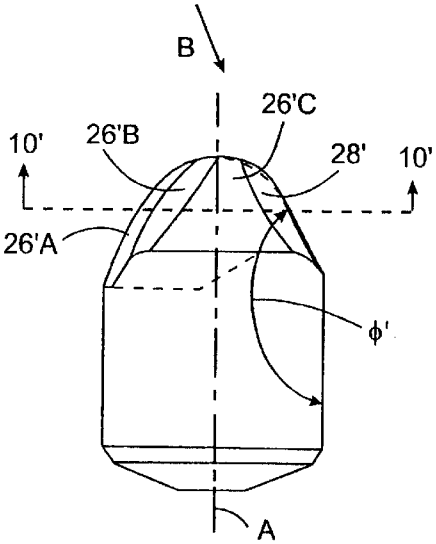
Figure 9:
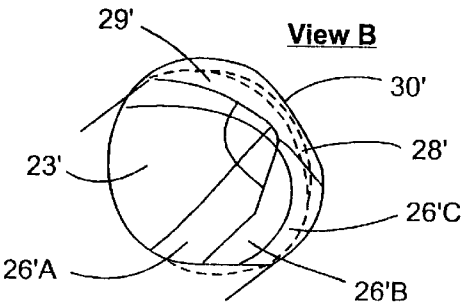

The radius zone line 24' or 25' represents a smooth transition between the first portion 23' and second portions 26' and 27'. The second portion 26' consists of three smoothly connected parts. A first part 26'A of the second portion 26' and the second portion 27' are except for the immediate junction with the first portion disposed generally outside the ballistic basic shape (drawn with broken lines in FIGS. 6, 7 and 10) and is generally perpendicular with each other in the cross-section 10'. The radius of the first part 26'A and the second portion 27' in the section 10' is larger than the radius R'1 of the first portion and is in the same magnitude as the above-mentioned radius R2. The first part 26'A and the second portion 27' substantially tapers in the axially forward direction of the centre axis A and form an angle β', generally perpendicular in cross-section 10'.

A second part 26'B of the second portion 26' is disposed radially outside the ballistic basic shape. The radius R'2B of the second part in the cross-section 10 is larger than the radius R'1 of the first portion but smaller than the radius R2. The second part substantially tapers in the forward direction of the centre axis A.

A third part 26'C of the second portion 26' is also disposed radially outside the ballistic basic shape on the windward side W of the normal N1 of the insert. The radius R'2C of the third part in the cross-section 10' is larger than the radius R'1 of the first portion. The third part substantially tapers in the forward direction of the centre axis A. The windward side W is the part of the insert that wears the most during machining of the rock material.

The third part 26'C and the second portion 27' further connects to third portions 28' and 29', respectively. The third portions merge radially off the axis A at the front portion of the insert 14'. The third portion 29' is much larger, at least 2 times larger, than the portion 28'. A tangent of the third portion 28' at the intersection of cross-section 10' is at larger internal angle ϕ'1 with respect to the envelope surface of the shank portion than are corresponding tangents of the first portion 23' and the third portion 29'. The angle ϕ'1 giving rise to an further increase in material to wear in comparison with an entire ballistic configuration and thus increases the wear resistance of the insert. The third portion 29' is formed on the leeward side L of the normal N1 is defined by a radius R'3 which is smaller than both the radius R'1 of the first portion and the radius R'2 of the second portion in the cross-section 10' (see FIG. 10). The width of the third portion 28' is substantially constant while the portion 29' tapers considerably axially forwards. The third portion 29' defines a strong crest like cutting edge.

The third portions 28' and 29' smoothly connects to a fourth portion 30' which is adapted to mainly coincide with and lie mainly flush with the wall of the drilled hole. The fourth portion defines a guiding surface provided to slide on the wall. The fourth portion has a radius R'4 in the cross-section 10, which is much larger than each of the above-mentioned radii R'1 and R'3. A central tangent of the portion 30' forms an internal angle ϕ' relative to the envelope surface of the shank 20 in the cross-section 10'. The angle ϕ' is smaller than corresponding angles of each of the other portions 23'–27'.

A first part of the base line Y' connected to the first portion 23', extends substantially perpendicular to the center axis A. A second part of the base line Y' connected to the portions 26'A and 27', rises at least partially, forwardly at an acute angle δ' relative to the first part. Third parts of the base line Y' connected to the third part 26'C and the third portion 29', disclose the axially forwardmost point of the entire base line. One of the third parts of the base line in connection with the third portion 29' is convex in a side view, while the other third part connected to the third part 26'C is mainly straight. A fourth part of the base line Y' connected to the fourth portion 30', is generally defined by a radius R'5 (in a side view) which is about the same as radius R'1. The fourth part is concave and its rearwardmost point lies axially forwards of the first part.

The fifth portion 31' is a rounded apex wherein the portions 23',26'A,26'B,26'C and 27' merge. The fourth portion 30' ends axially rearwardly of the apex 31'. The axially forwardmost part of the third portion 28 or 29 is mainly not a part of the apex although it is connected thereto.

It should be noted that at the base line Y' the above-mentioned radii R'1,R'2B,R'2C,R'3 and R'4 in a top view projection, are equal, i.e., equal to D/2.

Figure 12:
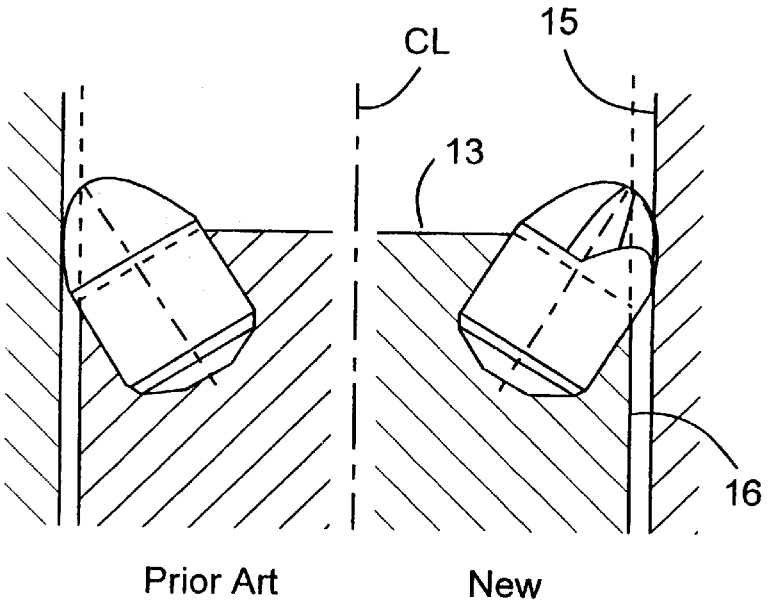
FIG. 12 shows a side view, partly in section, of a schematically illustrated drill head with a ballistic insert and an insert according to the present invention, in a bore hole.
Figure 11:
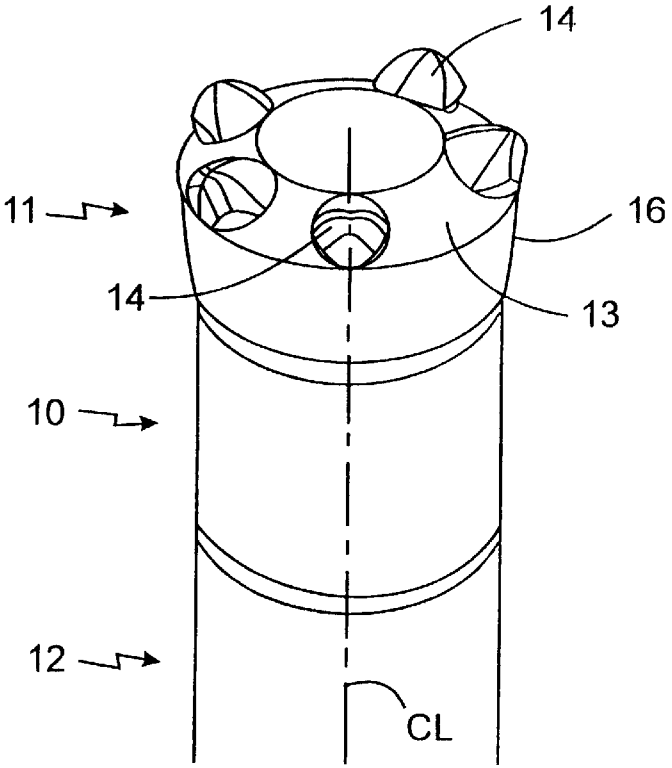
FIG. 11 shows a drill head according to the present invention, in a perspective view.
Figure 14:
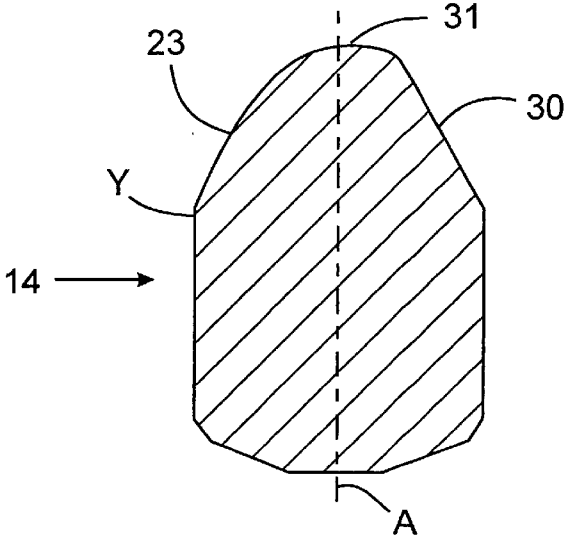
FIGS. 13 to 18 show cross-sectional views through the center axes of the two cutting inserts.
Figure 15:
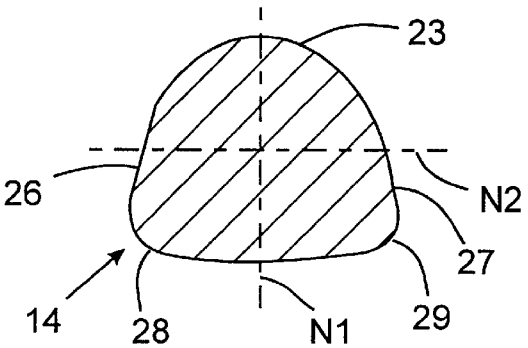
Figure 13:
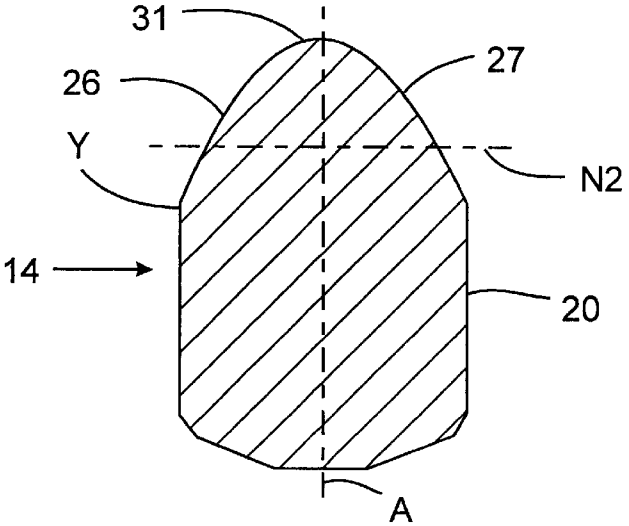
Figure 17:
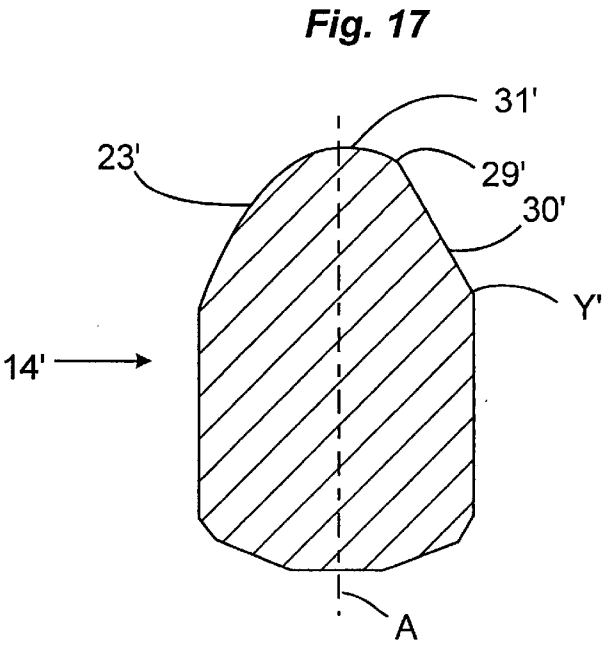
Figure 18:
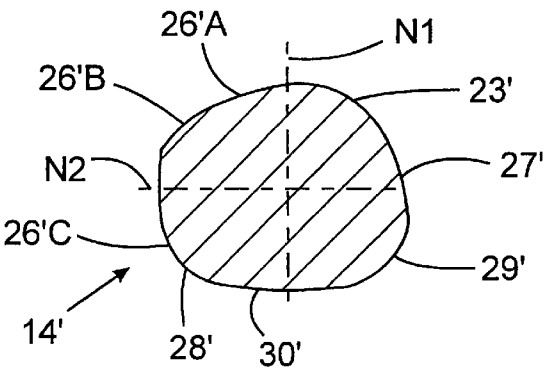
Figure 16:
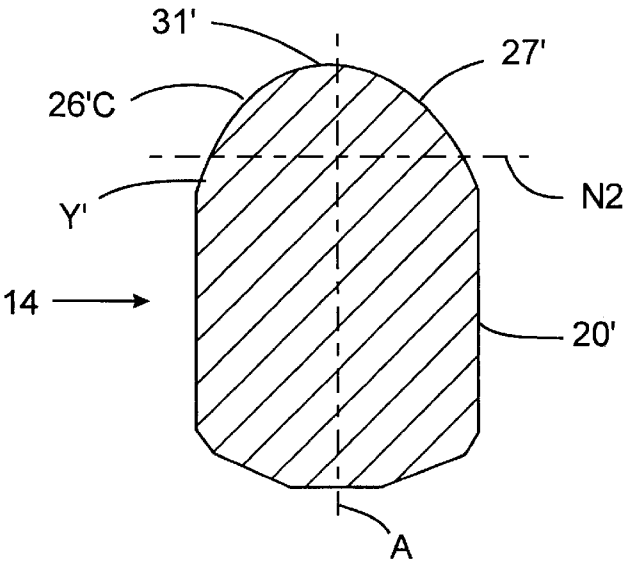

In the embodiment shown in a perspective view in FIG. 11, the improved rock drill bit of the impact type is generally designated 10 and has a drill head 11, a shaft 12, a front end including a front surface 13 provided with a plurality of fixed carbide inserts 14 or 14'. The jacket surface 16 of the rock drill bit 10 has a cylindrical or frusto-conical shape, and is defined in FIG. 11 at the drill head. The jacket surface is defined at the largest diameter of steel part of the drill bit body. The inserts 14, 14' are inserted into holes in the drill bit body so that their radially outermost surfaces 30, 30' substantially coincide with the jacket surface of the drill bit. It is understood that the word "substantially" in this context includes a radial displacement of −2 to +2 mm relative to the jacket surface 16 of the drill bit, preferably +0.2 to +0.5 mm. The inserts 14, 14' are arranged such that the steel body will not be excessively worn and therefore the diameter of the bore 15 remains substantially constant during the entire drilling operation. The front surface 13 may have a number of more centrally placed inserts (not shown) of appropriate shape, for example semi-spherical shape, the latter inserts cracking rock material closer to the center line CL of the drill bit. In FIG. 12 are shown a prior art solution to the left and an insert according to the present invention to the right, partly in cross-section. An insert with a ballistic working part has a volume that is 50% greater than a corresponding semispherical working part. The volume of the insert 14 or 14' is at least 50% greater than the ballistic shape and has a life which is in parity therewith. In FIG. 12 an imaginary extension of the jacket surface 16 is drawn with broken lines so as to illustrate differencies in volume of the two inserts.

Common for the two above-captioned cutting inserts is that at least the outer portion 22, 22' can be provided with a polycrystalline diamond coating. The coating is provided on at least the working portion of the insert to enhance the life of the insert although the PCD-coating may have cracked or flaked off.

In this connection it should be pointed out that the invention described above is not limited to the preferred embodiments but can be varied freely within the scope of the appending claims. For instance when the rock to be drilled is extremely hard (e.g. cracked and lamellar magnetite+ quartzite rock) it will be necessary to reduce the height between the apex and the base line Y, Y' thereby increasing the average thickness of the working part 22, 22' and thus increasing wear resistance. Such modification would render the ballistic surfaces 23, 23' to assume a generally spherical shape.

What is claimed is:

1. A cutting insert of cemented carbide preferably for percussive drilling, comprising:

a generally cylindrical mounting portion and an outer portion arranged at a front end of a rock drill bit, said outer portion including a relatively flat surface extending from said mounting portion in a direction towards a forward end of said insert, said mounting portion having a center axis, said mounting portion having a radius, the outer portion has a convexly curved basic shape, radially outside which a major part of the outer portion projects, the relatively flat surface smoothly connects to other components of said outer portion, a radius of the relatively flat surface is larger than the radius of the mounting portion, and the relatively flat surface circumferentially connects to at least one crestlike cutting edge.

2. A cutting insert according to claim 1, wherein the outer portion has a ballistic basic shape.

3. A cutting insert according to claim 1, wherein a junction of the mounting portion and the outer portion forms a base line which is concave, as seen in a side view, at the relatively flat surface thereby defining an axially rearward most point and that said rearward most point is disposed axially forward of the base line at the convexly curved basic shape but axially rearward of an axially forward most part of the base line.

4. A cutting insert according to claim 1, wherein at least the outer portion is provided with a polycrystalline diamond coating.

5. A rock drill bit of the impact type comprising:

a shaft, a boring head situated at a forward end of said shaft and defining a first longitudinal axis, said boring head comprising a generally forwardly facing front end including a front surface, a jacket surface extending generally longitudinally and defining the outer periphery of said boring head, and a plurality of holes formed in said front end, said holes each having a generally cylindrical basic shape and accommodating a cemented carbide cutting insert, each insert comprising a generally cylindrical mounting portion having a center axis and an outer portion extending out of said hole, said outer portion including a relatively flat surface extending from the mounting portion towards a forward end of the insert, the outer portion has a convexly curved basic shape, radially outside which a major part of the outer portion projects, the relatively flat surface smoothly connects to other components of said outer portion, a radius of the relatively flat surface is larger than a radius of the mounting portion, and the relatively flat surface circumferentially connects to at least one crestlike cutting edge.

6. A rock drill bit according to claim 5, wherein the outer portion has a ballistic basic shape.

7. A rock drill bit according to claim 5 wherein at least the outer portion is provided with a polycrystalline diamond coating.

* * * * *